US010717124B2

(12) United States Patent
Nakao et al.

(10) Patent No.: US 10,717,124 B2
(45) Date of Patent: Jul. 21, 2020

(54) PRESS FORMING METHOD AND PLATE MATERIAL EXPANSION DEVICE USED IN SAID METHOD

(71) Applicant: HONDA MOTOR CO., LTD., Minato-ku, Tokyo (JP)

(72) Inventors: Keiichiro Nakao, Wako (JP); Naoki Takahashi, Wako (JP); Kazuki Miyamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 517 days.

(21) Appl. No.: 15/510,527

(22) PCT Filed: Aug. 20, 2015

(86) PCT No.: PCT/JP2015/073317
§ 371 (c)(1),
(2) Date: Mar. 10, 2017

(87) PCT Pub. No.: WO2016/039102
PCT Pub. Date: Mar. 17, 2016

(65) Prior Publication Data

US 2017/0259320 A1 Sep. 14, 2017

(30) Foreign Application Priority Data

Sep. 12, 2014 (JP) ..... 2014-186676

(51) Int. Cl.
*B21D 22/26* (2006.01)
*B21D 5/08* (2006.01)
(Continued)

(52) U.S. Cl.
CPC ..... *B21D 22/26* (2013.01); *B21B 1/224* (2013.01); *B21D 5/08* (2013.01); *B21D 22/20* (2013.01);
(Continued)

(58) Field of Classification Search
CPC ... B21D 1/00; B21D 1/02; B21D 1/05; B21D 5/06; B21D 5/08; B21D 5/14;
(Continued)

(56) References Cited

U.S. PATENT DOCUMENTS 3,260,093 A * 7/1966 Polakowski ..... B21B 1/222 72/163
3,931,725 A * 1/1976 Yon ..... B21D 5/08 72/181
(Continued)

FOREIGN PATENT DOCUMENTS

CN 103822081 A * 5/2014 ..... B21D 35/006
JP 62-244525 A 10/1987
(Continued)

OTHER PUBLICATIONS

Michael Lindgren, "Experimental and Computational Investigation of the Roll Forming Process", 2009, University of Luleå, pp. 1-46, <http://www.diva-portal.org/smash/record.jsf?pid=diva2%3A998941&dswid=-614>. (Year: 2009).*
(Continued)

*Primary Examiner* — Gregory D Swiatocha
(74) *Attorney, Agent, or Firm* — Carrier Blackman & Associates, P.C.; Joseph P. Carrier; Fulchand P. Shende

(57) ABSTRACT

A press forming method is capable of improving material yield while avoiding the risk of dimensional error increase at product forming sections in blank material when carrying out press forming, and a plate material expansion device is used in this method. An end side of plate material for press forming is restricted by blank holding rollers, and pressure is applied to a middle location in the part that is restricted by a pressure roller. In this state, the plate material is transported in a rotating direction of the rollers being driven to continuously bend and extend the section receiving pressure. This bent and extended section is flattened with a flattening roller to obtain blank material wherein an end part is expanded.

7 Claims, 10 Drawing Sheets

(51) Int. Cl.

| | |
|---|---|
| ***B21D 22/22*** | (2006.01) |
| ***B21D 22/20*** | (2006.01) |
| ***B21D 25/00*** | (2006.01) |
| ***B21B 1/22*** | (2006.01) |
| ***B21B 1/38*** | (2006.01) |

(52) U.S. Cl.
CPC ..... *B21D 22/22* (2013.01); *B21D 25/00* (2013.01); *B21B 1/38* (2013.01)

(58) Field of Classification Search
CPC ..... B21D 22/20; B21D 22/22; B21D 22/26; B21D 25/00; B21D 25/04; B21D 35/005; B21D 35/006; B21D 5/083; B21D 13/04; B21B 1/224; B21B 1/38
USPC ..... 72/350
See application file for complete search history.

(56) References Cited

U.S. PATENT DOCUMENTS

| | | | | |
|---|---|---|---|---|
| 4,969,346 | A * | 11/1990 | Bosl | B21D 5/08 72/177 |
| 6,904,780 | B2 * | 6/2005 | Bullinger | B21H 8/00 72/130 |
| 2008/0295563 | A1 | 12/2008 | Terziakin | |
| 2011/0094283 | A1 * | 4/2011 | Flehmig | B21D 22/22 72/347 |
| 2011/0107808 | A1 * | 5/2011 | Gil | B21D 5/14 72/224 |
| 2014/0157850 | A1 * | 6/2014 | Buta | B21D 1/02 72/160 |

FOREIGN PATENT DOCUMENTS

| | | | |
|---|---|---|---|
| JP | 62244525 | A | * 10/1987 |
| JP | 07-060372 | A | 3/1995 |
| JP | 07-275963 | A | 10/1995 |
| JP | 09-150224 | A | 6/1997 |
| JP | 2003-080303 | A | 3/2003 |
| JP | 2004-160490 | A | 6/2004 |
| JP | 2004-188564 | A | 7/2004 |

OTHER PUBLICATIONS

Machine Translation of CN 103822081, Zhi et al., pp. 1-15, translated on Mar. 20, 2019. (Year: 2019).*
Machine translation of JP 62-244525, Translated Dec. 8, 2019, 9 Pages. (Year: 1987).*

* cited by examiner (A)

(B)

PRESS FORMING METHOD AND PLATE MATERIAL EXPANSION DEVICE USED IN SAID METHOD

TECHNICAL FIELD

The present invention relates to a press forming method which enhances material yield when a plate material is press-processed, and to a plate material expansion device which is applied to this method.

BACKGROUND ART

In one known method in press forming, press forming is performed on a blank material, which is a raw material for press forming having predetermined dimensions, in a state where a peripheral portion, which is not formed into a product shape part, is press-constrained by pressing the product shape part into the side of a die with a punch and thereby applying plastic deformation. In this case, the peripheral portion is press-constrained by sandwiching the peripheral portion of the blank material between the die of a press molding machine and a blank holder or between upper and lower blank holders. Hence, the peripheral portion is a so-called grip margin which is necessary for constraining the position of the blank material during forming, and is scrapped by being cut in a subsequent step. Therefore, it is advantageous to minimize the peripheral portion which corresponds to the grip margin described above so as to enhance the material yield.

On the other hand, in press forming, a forming method is proposed in which the sheet metal work is formed with a punch press while pretension is being applied to the peripheral portion of a sheet metal work (blank material) so as to pull the peripheral portion in a planar direction (see cited document 1). In this method, since the extension of the product shape part is increased by the pretension and the length of the sheet metal work in the shape of a flat plate before the press forming can be reduced, it is assumed that the material yield will be enhanced.

Patent Document 1: Japanese Unexamined Patent Application, Publication No. H09-150224

DISCLOSURE OF THE INVENTION

Problems to be Solved by the Invention

However, when a blank material which is a plate material whose dimensions are standardized is press formed as a target, in the method disclosed in cited document 1, the dimensional error (in particular, the thickness dimensional error) of its product shape part is expanded by pretention, resulting in that it may be difficult to maintain the quality of the product at a high level.

The present invention is made in view of the foregoing, and an object thereof is to provide a press forming method which can enhance material yield while preventing the expansion of a dimensional error of a product shape part of a blank material and a plate material expansion device which is applied to this method.

Means for Solving the Problems

In order to achieve the above object, the following technologies are proposed herein.

(1) A press forming method including: an expansion step of at least partially expanding an end portion of a plate material so as to obtain a blank material having a dimension suitable for predetermined press forming (for example, the expansion step P1 which will be described later); and a forming step of performing the press forming in a state where a predetermined part of the end portion of the blank material obtained in the expansion step is constrained (for example, the forming step P2 which will be described later).

In the press forming method of the above (1), the plate material is subjected to the expansion step, and thus the end portion thereof is at least partially expanded, with the result that a blank material having the dimension suitable for the predetermined press forming is obtained. In the state where the end portion of said blank material expanded in the expansion step is constrained, the press forming is performed in the forming step. Hence, the end portion of the blank material constrained when the press forming is performed is a portion that is expanded larger than the dimension of the original plate material. Thus, even when a plate material smaller than a normal blank material is applied to the performance of the press forming method as the plate material, the constrained part corresponding to the so-called grip margin is sufficiently acquired. In the product shape part, the same dimension as the normal dimension of the blank material is acquired. Thus, the material yield can be enhanced while minimizing the dimensional error in the product shape part when the press forming is performed.

(2) The press forming method of the above (1), wherein the expansion step includes:

a stretching step of pressurizing and stretching the end portion of the plate material with a stretching processing tool (for example, the stretching step P210 which will be described later); and a smoothing step of flattening the portion of the plate material which is deformed into a nonplanar shape in the stretching step (for example, the smoothing step P220 which will be described later).

In the press forming method of the above (2), particularly in the press forming method of the above (1), the end portion of the plate material is pressurized in the stretching step such that the planar spreading is stretched. Furthermore, in the smoothing step, the portion of the plate material which is deformed into a nonplanar shape in the stretching step is flattened. Consequently, said end portion is processed so as to be drawn in a planar direction, and thus the original plate material is extended to about a size equivalent to the normal blank material. Hence, although a raw material whose dimension is smaller than the normal blank material is applied as the plate material, a flat and appropriately wide constrained part (so-called grip margin) is acquired in the blank material to be press formed. Thus, the material yield can be enhanced while minimizing the dimensional error in the product shape part when the press forming is performed.

(3) The press forming method of the above (2), wherein the stretching step is a step that is gradually performed by performing stretching processings in which the width to be stretched each time is different for a plurality of times (for example, the processings from the first stretching processing P211 to the fifth stretching processing P215, which will be described later).

In the press forming method of the above (3), particularly in the press forming method of the above (2), the stretching step is gradually performed by performing the stretching processings in which the width to be stretched each time is different for a plurality of times, and thus the part is stretched satisfactorily and reliably, resulting in that the constrained part for when the press forming is performed is acquired by the stretched part.

(4) The press forming method of the above (2) or (3), wherein the stretching step is a step which is performed in a state where the plate material is constrained, with a member (for example, blank hold rollers 810*a* and 810*b*, which will be described later) onto which a bead (for example, the convex bead 811, the concave bead 812, which will be described later) is formed, by said bead part.

In the press forming method of the above (4), particularly in the press forming method of the above (2) or (3), the plate material can be stretched in a state where the plate material is securely constrained, with the member onto which the bead is formed, by said bead part. Hence, a sufficient constraining force can be obtained in the stretching step while the width of the region used for constraining the plate material is relatively narrowed. Thus, as a result, the material yield can be further enhanced.

(5) The press forming method of any one of the above (2) to (4), wherein a bending step of bending a tip end portion of the plate material before the stretching step is included, and the stretching step is performed while a curved portion of the tip end portion of the plate material which was bent in the bending step is hooked on a holding processing tool.

In the press forming method of the above (5), particularly in the press forming method of any one of the above (2) to (4), the stretching step is performed while the curved portion of the tip end portion of the plate material formed in the bending step is hooked on the holding processing tool, and thus the stretching step can be reliably performed utilizing the hooking on the narrow portion. Hence, a product equivalent to a case where a normal sized blank material is applied can be formed while applying a relatively small plate material as the plate material.

(6) The press forming method of any one of the above (2) to (5), wherein the smoothing step is a step that is gradually performed by performing smoothing processings with differently shaped smoothing processing tools for a plurality of times.

In the press forming method of the above (6), particularly in the press forming method of any one of the above (2) to (5), said end is flattened satisfactorily and appropriately in the smoothing step.

(7) A plate material expansion device including: a stretching processing tool for bringing a pressing member thereof into contact with an end portion of a plate material so as to pressurize and stretch the end portion of said plate material;

a holding processing tool for holding both side parts of the part of said plate material which is pressurized and stretched with the pressing member of the stretching processing tool; and a smoothing processing tool for flattening the portion of the plate material which is deformed into a nonplanar shape with the stretching processing tool.

In the blank material expansion device of the above (7), in a state where two parts of the blank material are constrained with the stretching processing tool, a part between these two parts is pressed with the pressing member of the stretching processing tool. By the pressing, the predetermined end portion of the blank material is bent and stretched. Furthermore, with the smoothing processing tool, the corresponding portion of the blank material which is bent and stretched is flattened.

Effects of the Invention

According to the present invention, a press forming method which can enhance material yield while preventing the expansion of a dimensional error of a product shape part of a blank material and a plate material expansion device which is applied to this method can be realized.

PREFERRED MODE FOR CARRYING OUT THE INVENTION

Figure 1:
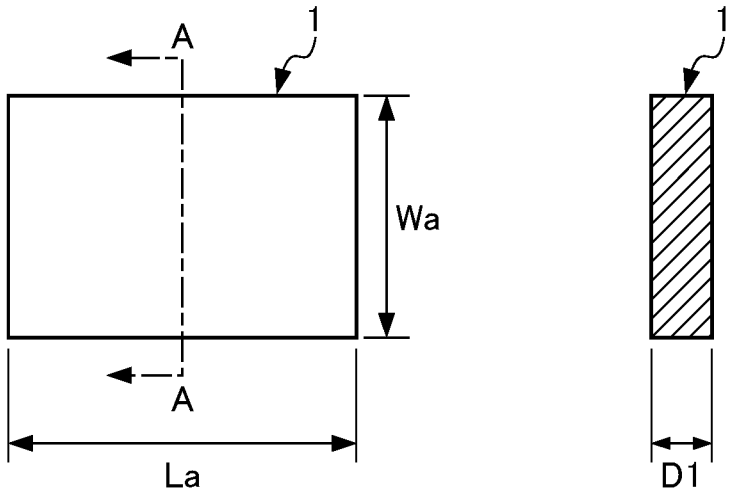
FIG. 1 is a conceptual diagram showing the principles of an effect of enhancing material yield in the present invention.
Figure 1:
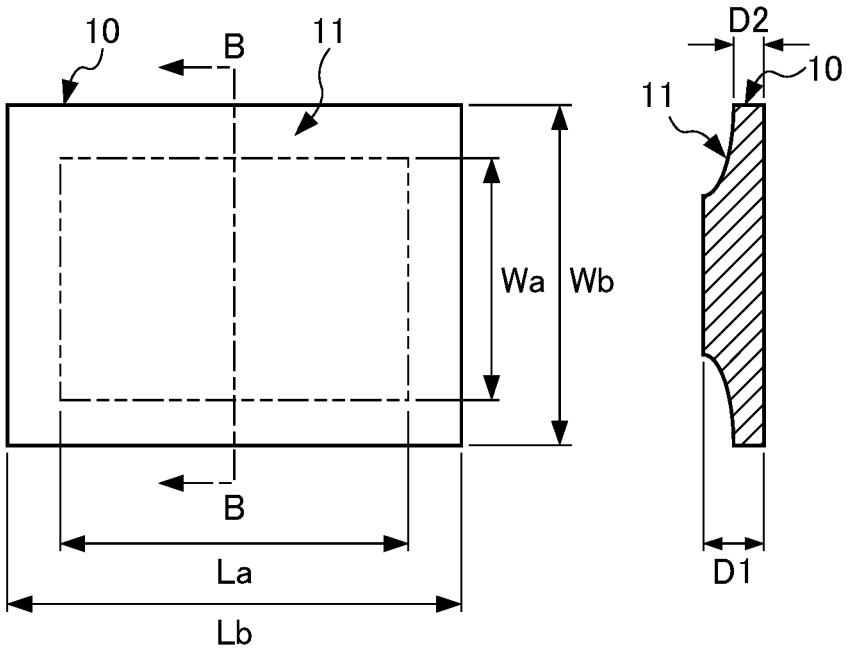

FIG. 1 is a conceptual diagram showing the principles of an effect of enhancing material yield in the present invention.

The (A) portion of FIG. 1 shows a plate material 1 before the application of the present invention which has given dimensions. The left side of the (A) portion shows the plate material 1 seen in plan view, and the right side of the (A) portion shows the plate material 1 seen in cross section taken along line A-A. It is assumed that the length of the plate material 1 is La, its width is Wa, and its thickness is D1.

The (B) portion of FIG. 1 shows a plate material 1 to which the present invention is applied. The left side of the (B) portion shows the plate material 1 seen in plan view, and the right side of the (B) portion shows the plate material 1 seen in cross section taken along line B-B. With respect to the plate material 1 to which the present invention is applied, its length is extended from La to Lb, and its width is increased from Wa to Wb, with the result that a blank material 10 having dimensions suitable for predetermined press forming is formed. In this case, as seen in cross section taken along line B-B, the product shape part, which is set inside the outside shape of the plate material 1 depicted in the (A) portion and is a target for the press forming, maintains its original thickness D1. On the other hand, a portion 11, which is drawn outward of the product shape part as the so-called grip margin, has a thickness D2 obtained by reducing the original thickness D1 as a result of extending the peripheral portion of the plate material 1 depicted in the left side of the (A) portion in the expansion step described later by, for example, a pressing force in a surface direction.

In other words, in the present invention, a blank material having predetermined dimensions to be press formed is obtained from a plate material which is equal in thickness to said blank material and whose planar projection is relatively smaller than the blank material. Hence, regarding the outside shape of the blank material, the portion which is drawn to the outside of the product shape part as the so-called grip margin is formed by expanding a predetermined end portion (the peripheral portion in the case of FIG. 1) with respect to said small plate material.

Consequently, as compared with the conventional method wherein the press forming is performed using a blank material having the predetermined dimensions including the so-called grip margin from the beginning, a formed product equivalent to a conventional one can be obtained from a relatively smaller plate material, resulting in that the material yield is enhanced.

Figure 2:
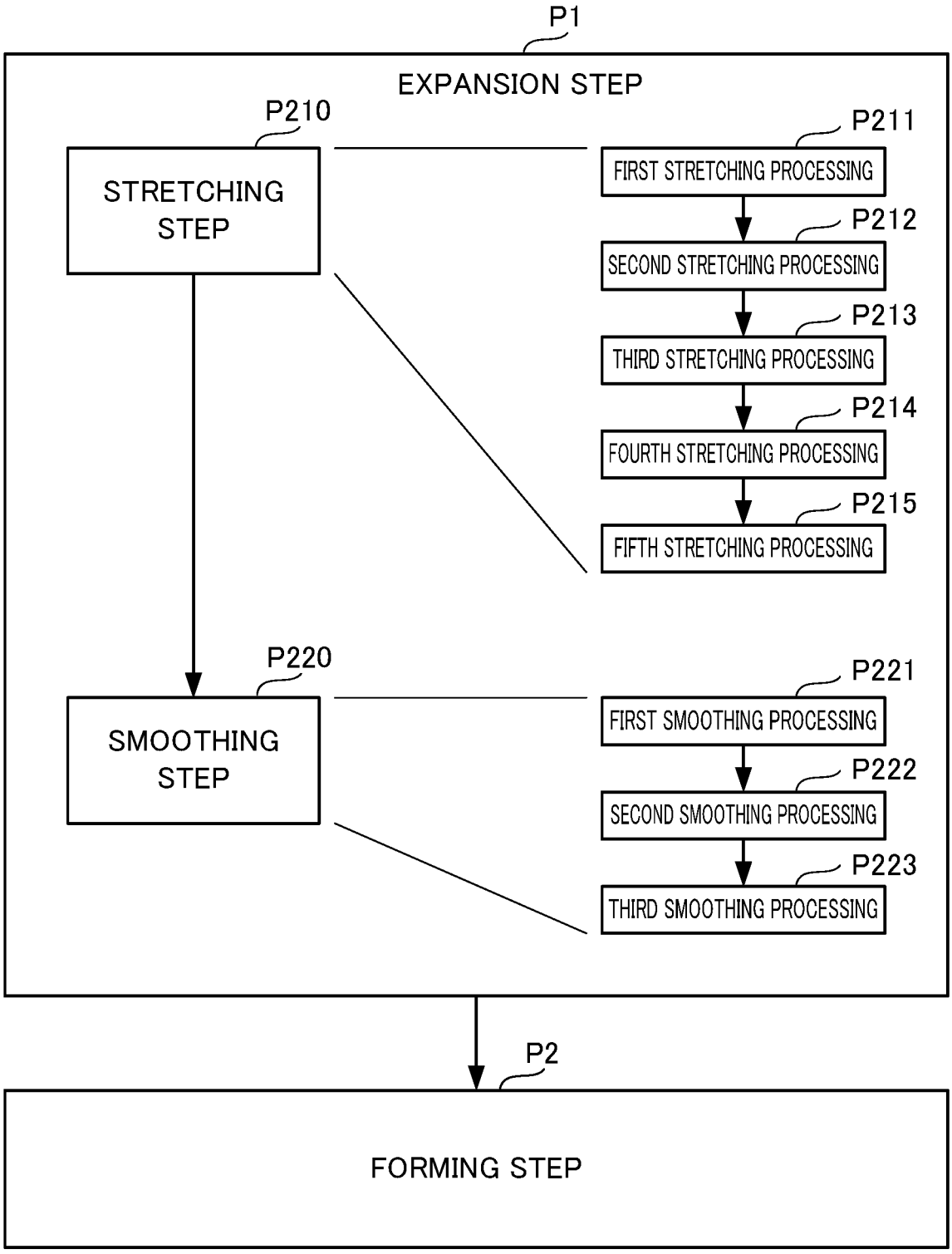
FIG. 2 is a process diagram showing a press forming method according to an embodiment of the present invention.

FIG. 2 is a process diagram showing a press forming method according to an embodiment of the present invention.

In the press forming method according to the embodiment of the present invention, first, the expansion step P1 of expanding the end portion (a predetermined partial region on the end edge side) of a plate material to obtain a blank material having dimensions suitable for predetermined press forming is performed. Then, a forming step P2 of performing press forming in a state where the end portion of the blank material obtained in the expansion step P1 is constrained is performed.

The expansion step P1 includes: a stretching step P210 of pressurizing and stretching the end portion of the plate material with a stretching processing tool; and a smoothing step P220 of flattening the portion of the plate material which is deformed into a nonplanar shape in the stretching step P210.

In this embodiment, the stretching step P210 described above includes first stretching processing P211, second stretching processing P212, third stretching processing P213, fourth stretching processing P214 and fifth stretching processing P215. The processings, from the first stretching processing P211 to the fifth stretching processing P215, are gradual processings in which the predetermined end portion of the plate material is sequentially expanded.

The smoothing step P220 includes first smoothing processing P221, second smoothing processing P222 and third smoothing processing P223. The processings, from the first smoothing processing P221 to the third smoothing processing P223, are gradual processings in which the portion of the plate material that is deformed into a nonplanar shape for the expansion in the stretching step P210 described above is sequentially flattened.

Figure 3:
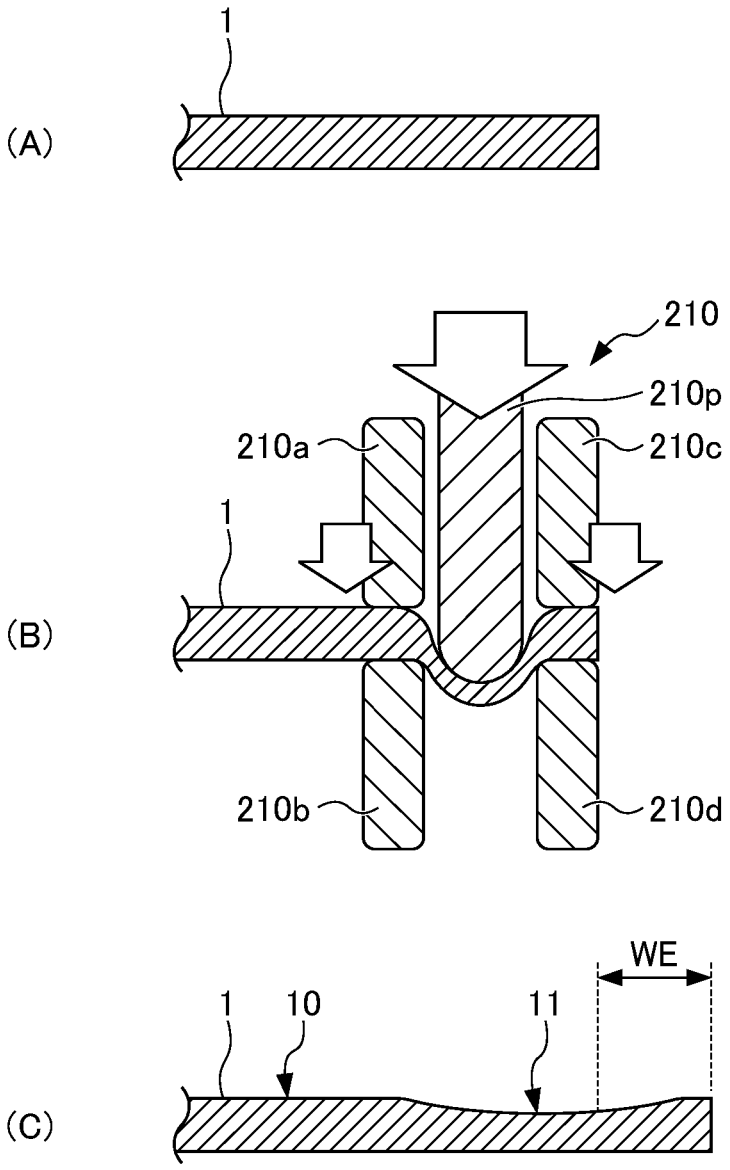
FIG. 3 is a diagram for illustrating an expansion step in the process diagram of FIG. 2.

FIG. 3 is a diagram for illustrating the expansion step P1 in the process diagram of FIG. 2.

In the (A) portion of FIG. 3, a cross section of the plate material 1 which is subjected to the expansion step P1 is shown.

The (B) portion of FIG. 3 shows how the end portion of the plate material 1 of the (A) portion is pressurized and stretched with the processing tool in the stretching step P210 of the expansion step P1. For convenience of description, this processing tool 210 is obtained by symbolically showing the processing tools used in the stretching step P210.

The processing tool includes two pairs of blank hold rollers which sandwich, from above and below, the end portion (the predetermined partial region on the end edge side) of the plate material 1 a given distance apart, that is, an upper left side blank hold roller 210*a*, a lower left side blank hold roller 210*b*, an upper right side blank hold roller 210*c* and a lower right side blank hold roller 210*d*. The blank hold rollers 210*a* and 210*b* and the blank hold rollers 210*c* and 210*d*, which form pairs in an up/down direction, sandwich the end portion of the plate material 1 from above and below with a given load to constrain the plate material 1 such that the plate material 1 is prevented from being displaced in the shaft direction (in the figure, the left-right direction) of the blank hold rollers.

In this state, a pressure roller 210*p* is located between the upper blank hold rollers, between 210*a* and 210*c*, which form a pair in the left-right direction, and presses the plate material 1 from the upper surface thereof while deforming it into a concave shape so as to stretch the plate material.

In this case, the blank hold rollers 210*a*, 210*b*, 210*c* and 210*d* and the pressure roller 210*p* are all driven rollers, and roll in contact with the plate material 1 while applying predetermined loads to the plate material 1 according to displacements when the plate material 1 is transported with a separate means (unillustrated) in a direction perpendicular to the plane of the figure (for example, in a depth direction).

As described above, the end portion of the plate material 1 is deformed and stretched in the stretching step P210, and is thereafter flattened in the smoothing step P220. The smoothing step P220 will be described in detail later.

In the (C) portion of FIG. 3, as shown in the (B) portion, the cross section of the plate material 1 after the performing of the expansion step P1, in which the end portion is stretched in the stretching step P210 and is thereafter flattened in the smoothing step P220, is shown. In this state, the width of the plate material 1 on the side of the end portion is increased by WE and is thereby formed into the blank material 10 having dimensions suitable for the predetermined press forming. In the portion 11 which is drawn outward of the product shape part as the so-called grip margin of the blank material 10, the thickness dimension is relatively reduced but in the product shape part, the original thickness dimension is maintained.

In the expansion step P1, as described above, the end portion of the plate material 1 is at least partially expanded, and thus the blank material 10 having dimensions suitable for the predetermined press forming can be obtained.

Figure 4:
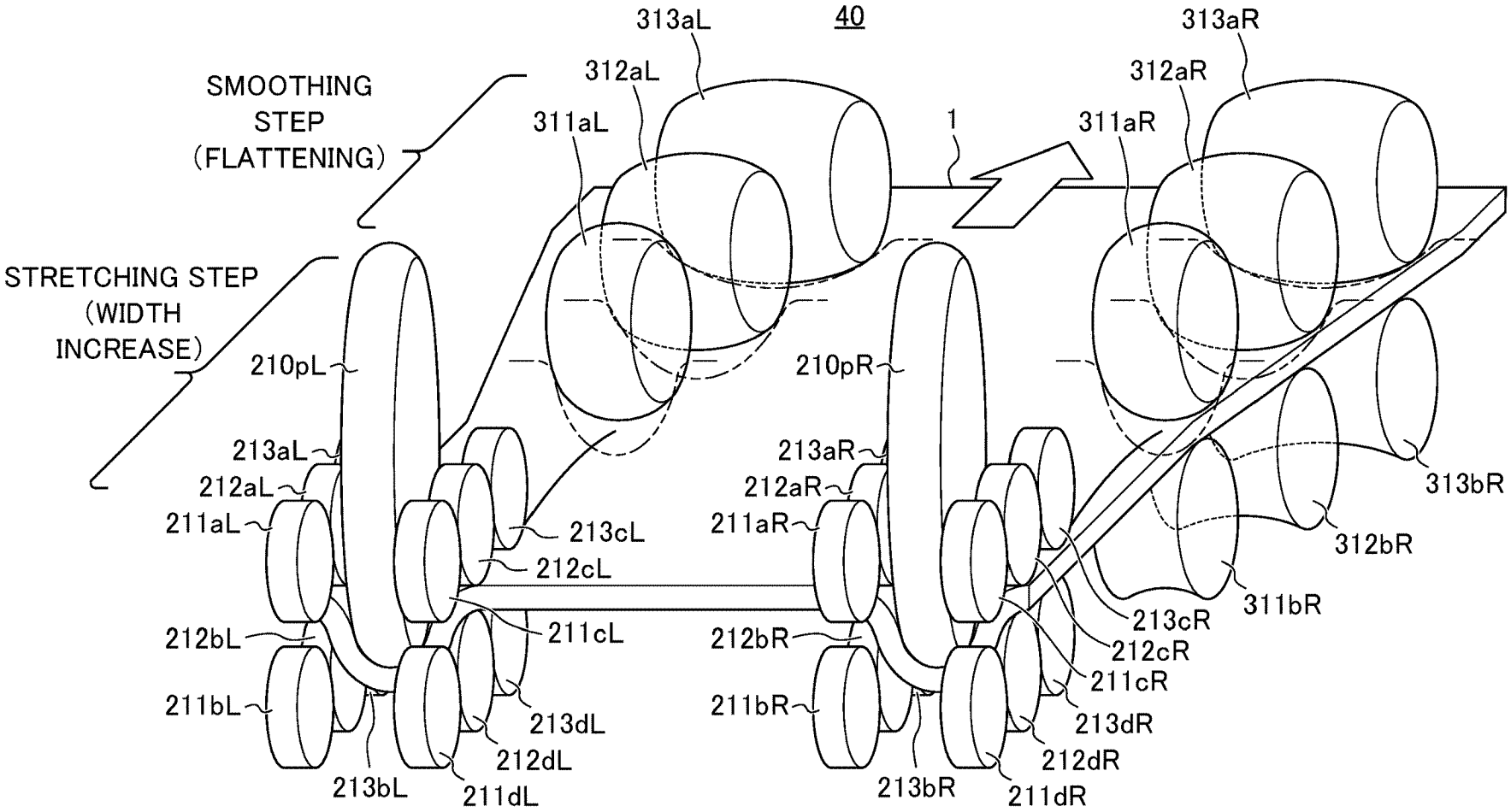
FIG. 4 is a diagram for illustrating a device used in the expansion step illustrated in FIG. 3.

FIG. 4 is a diagram for illustrating a plate material expansion device used in the expansion step illustrated in FIG. 3.

In FIG. 4, for convenience of understanding, some of the constituent elements of the plate material expansion device 40 are shown as representatives of a plurality of elements and the scale is partially changed so that the main portion can be seen in a glance within limited space.

The plate material expansion device 40 includes the stretching processing tools (typically, the left end side pressure roller 210*p*L and the right end side pressure roller 210*p*R which are the pressing members described above, unillustrated rotation shafts thereof and the like) for bringing its pressing members (typically, a left end side pressure roller 210*p*L and a right end side pressure roller 210*p*R) into contact with the end portion of the plate material 1 and thereby pressurizing and stretching the end portion of said plate material 1.

The plate material expansion device 40 also includes holding processing tools (typically, around the left end side pressure roller 210*p*L, upper left blank hold rollers 211*a*L, 212*a*L and 213*a*L, lower right blank hold rollers 211*b*L, 212*b*L and 213*b*L, upper right blank hold rollers 211*c*L, 212*c*L and 213*c*L and lower right blank hold rollers 211*d*L, 212*d*L and 213*d*L) for holding both side parts of the part of the plate material 1 which is pressurized and stretched with the pressing members (the pressure rollers 210*p*L and 210*p*R described above) of the stretching processing tools (the pressure rollers 210*p*L and 210*p*R, the unillustrated rotation shafts thereof and the like).

The plate material expansion device 40 also includes smoothing processing tools (typically, on the left end side of the plate material 1, upper smoothing rollers 311*a*L, 312*a*L and 313*a*L and lower smoothing rollers 311*b*L, 312*b*L and 313*b*L) for smoothing the portion of said plate material 1 which is deformed into a nonplanar shape with the stretching processing tool described above.

On the left end side of the plate material 1, the plate material 1 is held from above and below with the upper blank hold rollers 211*a*L, 212*a*L and 213*a*L, the lower blank hold rollers 211*b*L, 212*b*L and 213*b*L, the upper blank hold rollers 211*c*L, 212*c*L and 213*c*L and the lower blank hold rollers 211*d*L, 212*d*L and 213*d*L so as not to be displaced in the shaft direction (the direction intersecting the transport direction of the plate material 1). As shown in the figure, a given distance is provided between the left and right blank hold rollers. In this state, between the upper left and right blank hold rollers with the above distance provided therebetween, a load acting in a downward direction is applied by the upper pressure roller 210*p*L to the upper surface of the plate material 1.

The blank hold rollers and the pressure rollers are all driven rollers, and roll in contact with the plate material 1 while applying predetermined loads to the plate material 1 as the plate material 1 is transported in a direction (in this case, substantially in the depth direction) indicated by an arrow with a transport means (unillustrated).

Since the plate material 1 receives the load of the pressure roller 210*p*L in a state where both sides are constrained as described above with the blank hold rollers so as not to be displaced, the plate material 1 is stretched and deformed into a downward convex shape (hence, a concave shape).

Likewise, on the right end side of the plate material 1, the plate material 1 is held from above and below with the upper blank hold rollers 211*a*R, 212*a*R and 213*a*R, the lower blank hold rollers 211*b*R, 212*b*R and 213*b*R, the upper blank hold rollers 211*c*R, 212*c*R and 213*c*R and the lower blank hold rollers 211*d*R, 212*d*R and 213*d*R so as not to be displaced in the shaft direction (the direction intersecting the transport direction of the plate material 1). As shown in the figure, a given distance is provided between the left and right blank hold rollers. In this state, between the upper left and right blank hold rollers with the above distance provided therebetween, a load acting in a downward direction is applied by the upper pressure roller 210*p*R to the upper surface of the plate material 1. The corresponding rollers on the right end side are also driven rollers as are the rollers on the left end side described above.

In this way, on the right end side of the plate material 1 likewise, the plate material 1 receives the load of the pressure roller 210*p*R so as to be stretched and deformed into a downward convex shape (hence, a concave shape).

As described above, the plate material 1 is stretched with the pressure rollers 210*p*L and 210*p*R in a state where the plate material 1 is constrained on the left end side and the right end side thereof so as not to be displaced in the shaft direction of the corresponding blank hold rollers. This processing is the details of the first stretching processing P211 in FIG. 2.

Although the mechanical portion for performing the first stretching processing P211 is typically illustrated in FIG. 4 for convenience, in the plate material expansion device 40 of the present embodiment, five same mechanical portions as the above-described mechanical portion for performing the first stretching processing P211 are continuously installed.

With the five continuous mechanical portions described above, the stretching processings are performed in five stages (FIG. 2: P211 to P215), and thus the stretching step P210 for performing the desired stretching on the plate material 1 is performed.

The gradual stretching processing with the five continuous mechanical portions described above will be further described later with reference to FIG. 5.

In the above-described stretching step P210 with the plate material expansion device 40 of FIG. 4, the plate material 1 is stretched and is also deformed into a nonplanar shape (in this embodiment, a concave shape). The deformation is flattened in the smoothing step with the smoothing processing tool (FIG. 2: P220).

With respect to the smoothing processing tools, the processing tool for smoothing the left end side of the plate material 1 is formed as a mechanical portion which includes the upper smoothing rollers 311*a*L, 312*a*L and 313*a*L and the lower smoothing rollers 311*b*L, 312*b*L and 313*b*L which are not shown in FIG. 4.

The processing tool for smoothing the right end side of the plate material 1 is formed as a mechanical portion which includes the upper smoothing rollers 311*c*R, 312*c*R and 313*c*R and the lower smoothing rollers 311*d*R, 312*d*R and 313*d*R.

These smoothing rollers are aligned from the upstream side to the downstream side in the flow of the transport of the plate material 1 in the order described above, and three pairs of upper and lower rollers are aligned so that the plate material is flattened sequentially and gradually.

The configurations and actions of the mechanical portion for the smoothing step will be described in detail later.

Figure 5:
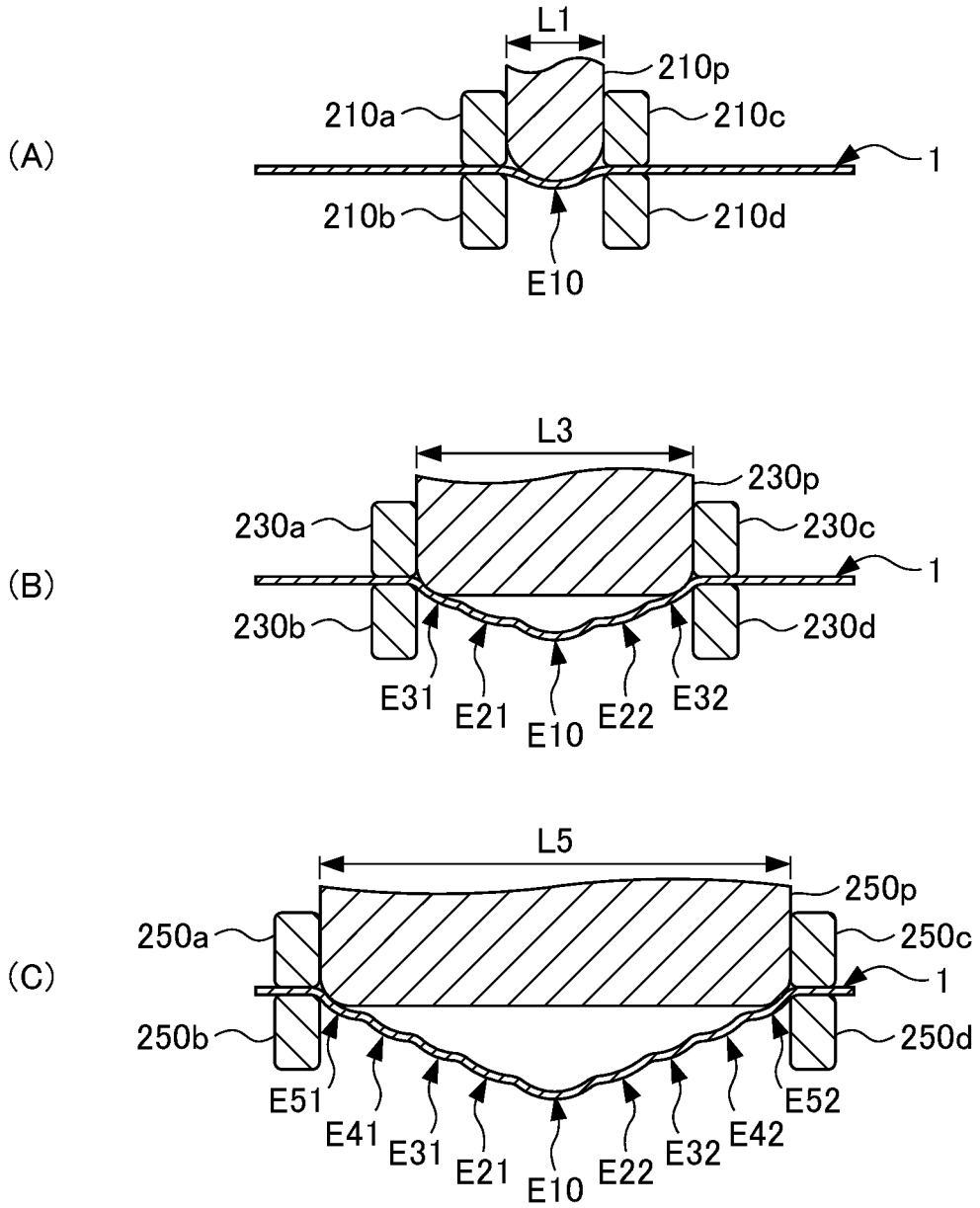
FIG. 5 is a diagram for illustrating an example of a stretching step in the expansion step in the process diagram of FIG. 2.

FIG. 5 is a diagram for illustrating an example of the stretching step P210 in the expansion step P1 in the process diagram of FIG. 2. In the stretching step in FIG. 5, a method of roll forming is applied. Devices in FIG. 5 used for performing processing in the individual stages of the stretching step P210 are assumed to be those which are previously described with reference to FIG. 4. However, with respect to the individual portions of mechanisms corresponding to the processing in the individual stages, reference numerals which represent the individual portions are applied to them.

FIG. 5 shows how the stretching of the end portion of the plate material 1 is extended in the order of the (A) portion, the (B) portion and the (C) portion. The (A) portion, the (B) portion and the (C) portion typically show three types of gradual processings among the five-stage stretching processings of the stretching step P210 described previously.

The (A) portion of FIG. 5 shows the first stretching processing P211. One part of the plate material 1 is constrained so as to be sandwiched between the blank hold rollers 210*a* and 210*b* from above and below. With a given distance L1 provided between the constrained part and the other part of the plate material 1, the other part is constrained likewise so as to be sandwiched between the blank hold rollers 210*a* and 210*b* from above and below. In a state where the plate material 1 is constrained as described above, a load is applied from between the left and right upper blank hold rollers 210*a* and 210*c* with the pressure roller 210*p* whose width is slightly narrower than the distance L1.

As described previously, each of the blank hold rollers 210*a*, 210*b*, 210*c* and 210*d* and the pressure roller 210*p* are all driven rollers, and roll in contact with the corresponding portions as the plate material 1 is transported. In this way, an intermediate portion of the part of the plate material 1 constrained by the left and right blank hold rollers is deformed into a downward convex shape (that is, a concave shape) and is stretched into the region E10 shown in the figure.

The (B) portion of FIG. 5 shows the third stretching processing P213. In the plate material 1 which is stretched through two stages by the processings up to the second stretching processing P212, which is the preceding stage, into the region E10 and regions E21 and E22 shown in the figure, one part is constrained so as to be sandwiched between the blank hold rollers 230*a* and 230*b* from above and below. With a given distance L3 (a distance wider than the region including the region E10 and the regions E21 and E22) provided between the constrained part and the other part of the plate material 1, the other part is constrained likewise so as to be sandwiched between the blank hold rollers 230*c* and 230*d* from above and below. In a state where the plate material 1 is constrained as described above, a load is applied from near the left and right upper blank hold rollers 230*a* and 230*c* with a pressure roller 230*p* whose width is slightly narrower than the distance L3.

Likewise, the blank hold rollers 230*a*, 230*b*, 230*c* and 230*d* and the pressure roller 230*p* are all driven rollers, and roll in contact with the corresponding portions as the plate material 1 is transported. In this way, an adjacent portion of the part of the plate material 1 constrained by the left and right blank hold rollers is deformed into a downward convex shape (that is, a concave shape) and is stretched into regions E31 and E32 shown in the figure.

The (C) portion of FIG. 5 shows the fifth stretching processing P215 which is the final stage of the stretching processing in the present embodiment. With respect to the plate material 1 which is stretched through four stages by the processing up to the fourth stretching processing P214, which is the preceding stage, into the regions E10, E21, E22, E31, E32, E41 and E42 shown in the figure, one part of the plate material 1 is constrained so as to be sandwiched between the blank hold rollers 250*a* and 250*b* from above and below. With a given distance L5 (a distance wider than the region including the regions E10, E21, E22, E31, E32, E41 and E42) provided between the constrained part and the other part of the plate material 1, the other part is constrained likewise so as to be sandwiched between the blank hold rollers 250*c* and 250*d* from above and below. In a state where the plate material 1 is constrained as described above, a load is applied from near the left and right upper blank hold rollers 250*a* and 250*c* with a pressure roller 250*p* whose width is slightly narrower than the distance L5. In this case as well, each of the blank hold rollers 250*a*, 250*b*, 250*c* and 250*d* and the pressure roller 250*p* are all driven rollers, and roll in contact with the corresponding portions of the plate material 1 as the plate material 1 is transported. In this way, an adjacent portion of the part of the plate material 1 constrained by the left and right blank hold rollers is deformed into a downward convex shape (that is, a concave shape) and is stretched into regions E51 and E52 shown in the figure.

It follows from the foregoing description with reference to FIG. 5 that in the stretching processing of the present embodiment, the target portion of the plate material is gradually stretched by performing stretching processings in which the widths to be stretched (widths of regions to be stretched) each time are different for a plurality of times. Hence, the plate material is prevented from being broken due to being stretched locally and excessively.

Figure 6:
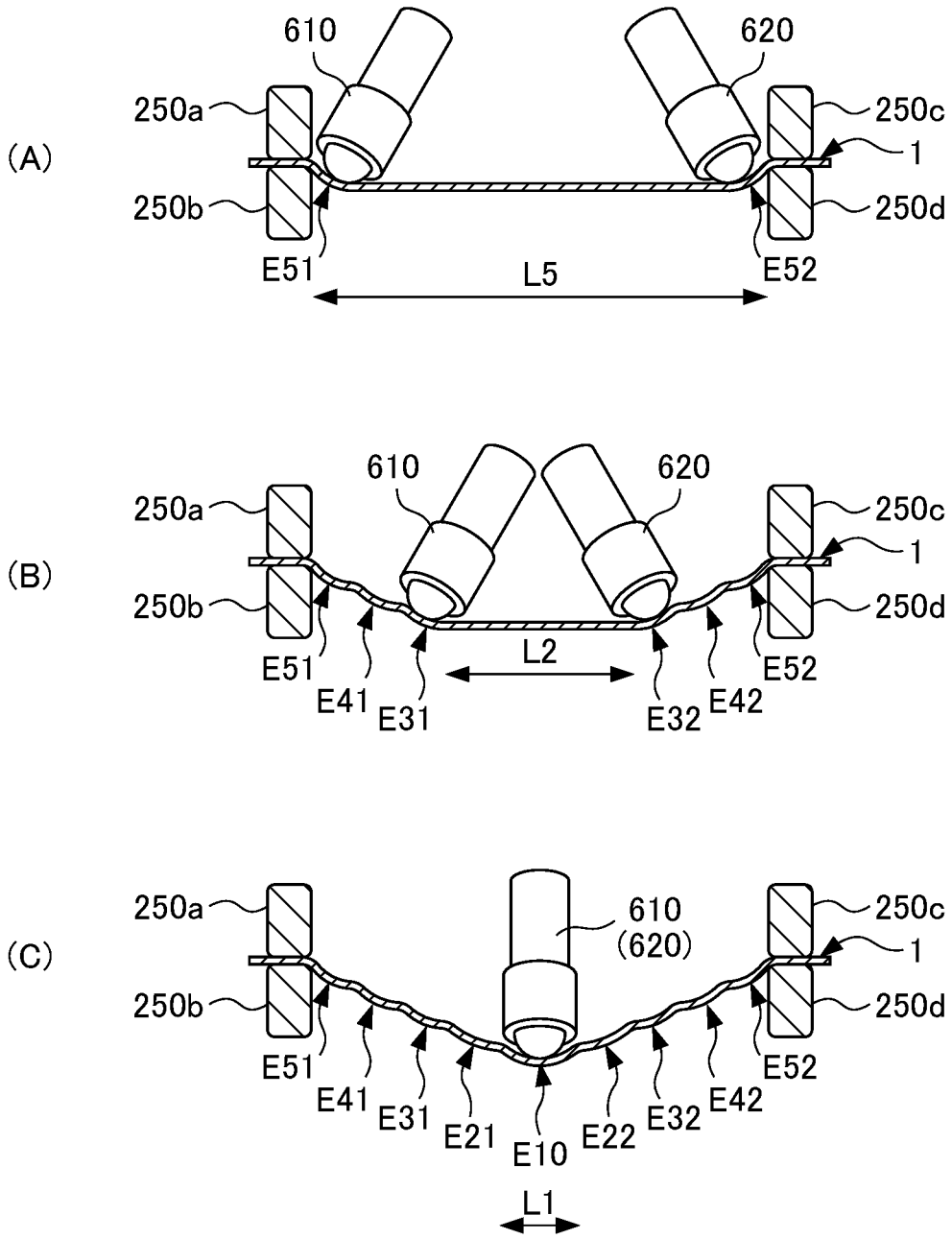
FIG. 6 is a diagram for illustrating another example of the stretching step in the expansion step in the process diagram of FIG. 2.

FIG. 6 is a diagram for illustrating another example of the stretching step in the expansion step in the process diagram of FIG. 2.

Incremental forming is applied in the stretching step of FIG. 6, and in this example, the region of the end portion of the plate material 1 is stretched sequentially and gradually with two cylindrical processing tools 610 and 620 in which the attitudes and the level positions are controlled with an NC or the like.

With respect to the sequential processing in the stretching step of FIG. 6, parts equivalent to the portions described with reference to FIG. 5 are identified with the same symbols, and a description will be given below.

The (A) portion of FIG. 6 shows the first stretching processing. One part (a part relatively on the left side) of the plate material 1 is constrained so as to be sandwiched between the blank hold rollers 250*a* and 250*b* from above and below. With a given distance L5 provided between the constrained part and the other part (relatively, the part on the right side) of the plate material 1, the other part is likewise constrained so as to be sandwiched between the blank hold rollers 250*c* and 250*d* from above and below.

In the stretching step of FIG. 6, through the stretching processings in all stages, the plate material 1 is constrained the given distance L5 apart with the same blank hold rollers 250*a*, 250*b*, 250*c* and 250*d*.

In a state where the plate material 1 is constrained as described above, loads are applied to portions between and adjacent to the upper blank hold rollers 250*a* and 250*c* with the processing tools 610 and 620. As the plate material 1 is transported, the left and right processing tools 610 and 620 maintain given attitude and level positions as schematically shown in the figure. Hence, parts to which the processing tools 610 and 620 are pressed are deformed into downward shapes (that is, concave shapes) and are stretched into regions E51 and E52 shown in the figure.

The (B) portion of FIG. 6 shows the third stretching processing. By the processings up to the second stretching processing, which is the preceding stage, the plate material 1 is stretched through two stages into the regions E51 and E52 and regions E41 and E42 shown in the figure. In the left and right processing tools 610 and 620, their attitudes are changed such that the angle formed by them is decreased as compared with the preceding stage (the distance between the head portions thereof is L2) as shown in the figure, and the level positions are changed so as to be lowered as compared with the preceding stage. With the left and right processing tools 610 and 620 whose attitude and positions are changed as described above, loads are applied to regions which are inward of and are adjacent to the regions E41 and E42 of the plate material 1. As the plate material 1 is transported, the left and right processing tools 610 and 620 maintain the given attitudes and level positions as schematically shown in the figure. Hence, parts to which the processing tools 610 and 620 are pressed are deformed into downward convex shapes (that is, concave shapes) and are stretched into regions E31 and E32 shown in the figure. The distance between the regions E31 and E32 is substantially the above-mentioned L2.

The (C) portion of FIG. 6 shows the fifth stretching processing which is the final stage of the stretching processing in the present example. In the fifth stretching processing, the plate material 1 stretched through four stages by the processings up to the fourth stretching processing, which is the preceding stage, into the regions E51, E52, E41, E42, E31, E32, E21 and E22 shown in the figure is further stretched between regions E21 and E22 with the one processing tool 610 (620). Specifically, the processing tool 610 (620) is changed such that the level position is further lowered, while maintaining the attitude without lateral inclination, as compared with the preceding stage. With the processing tool 610 (620) whose attitude and position are changed, a load is applied to the region between the regions E21 and E22 of the plate material 1. As the plate material 1 is transported, the processing tool 610 (620) maintains the given attitude and the given level position as schematically shown in the figure. Hence, the part to which the processing tool 610 (620) is pressed is deformed into a downward convex shape (that is, a concave shape) and is stretched into a region E10 shown in the figure. The width of the region E10 is about L1 in the (A) portion of FIG. 5.

Figure 7:
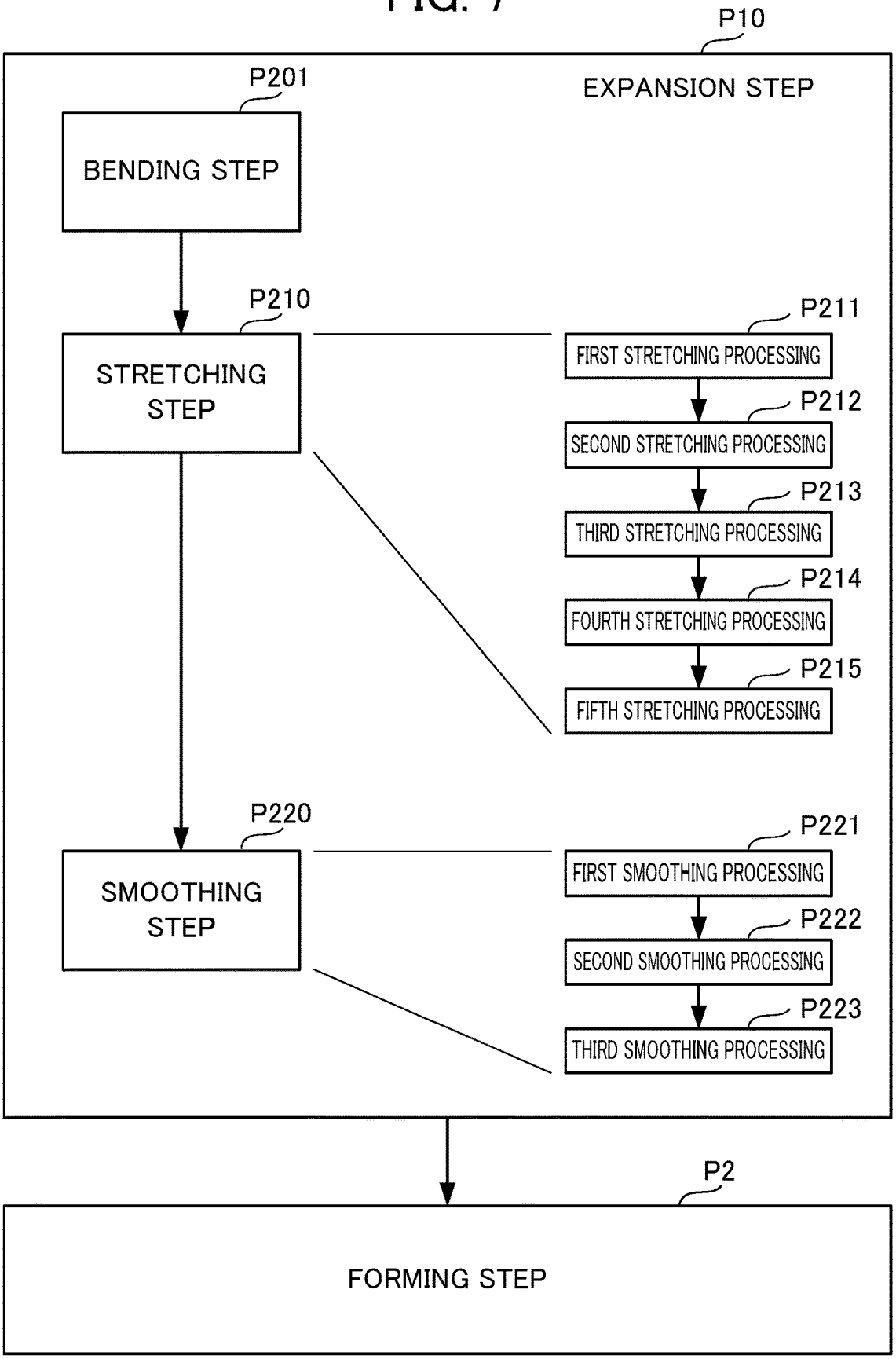
FIG. 7 is a process diagram showing a press forming method according to another embodiment of the present invention.

FIG. 7 is a process diagram showing a press forming method according to another embodiment of the present invention.

In FIG. 7, portions corresponding to the press forming method of FIG. 2 are identified with the same symbols.

The press forming method of FIG. 7 differs from the press forming method of FIG. 2 in that, in the expansion step P10, a bending step P201 of bending the end portion of the plate material 1 is performed before the stretching step P210 described previously, and that the stretching step P210 is performed while a tip end portion of the plate material 1 bent in the bending step P201 is being hooked on a holding processing tool (blank hold roller). Hence, although the processing in each stage after the stretching step P210 is substantially the same as that described previously with reference to FIG. 2 and the like, they are characteristic in their actions and effects.

Specifically, in the expansion step P10 of the press forming method of FIG. 7, since the stretching step is performed while the curved portion of the tip end portion of the plate material formed in the bending step P201 is being hooked on the holding processing tool, the stretching step can be reliably performed by utilizing the hooking on the narrow portion. Hence, a product equivalent to a case where a normal sized blank material is applied can be formed while applying a relatively small plate material as the plate material, resulting in that the material yield is further enhanced.

Figure 8:
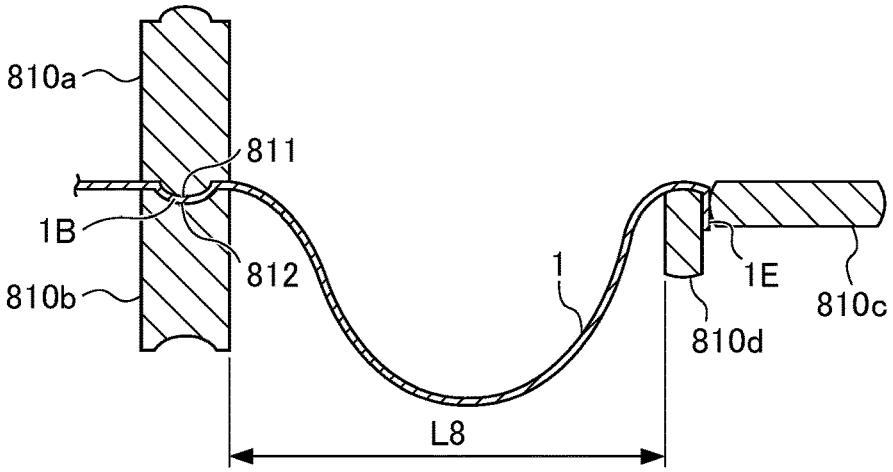
FIG. 8 is a diagram for illustrating an example of an expansion step in the process diagram of FIG. 7.

FIG. 8 is a diagram for illustrating an example of the stretching step P210 in the expansion step P10 of the process diagram of FIG. 7.

The tip end portion (right end edge side shown in the figure) 1E is bent substantially perpendicularly downward in the bending step P201 (here, the part 1E is referred to as a curved portion).

In the tip end portion of the plate material 1, the curved portion 1E is constrained so as to be hooked on a right side surface in the figure over the peripheral surface of a blank hold roller 810*d*. Furthermore, the curved portion 1E is constantly pressed to the right side surface side of the blank hold roller 810*d* by the peripheral surface of a blank hold roller 810*c* in which its shaft direction intersects (in this example, is perpendicular to) the blank hold roller 810*d*. Hence, in the plate material 1, the curved portion 1E is hooked on the blank hold roller 810*d*, and the hooking is securely constrained by the pressing action of the blank hold roller 810*d* such that the hooking is not disconnected.

A pair of upper and lower blank hold rollers 810*a* and 810*b* are provided a given distance L8 apart from the blank hold roller 810*d*, and the other portion of the plate material 1 is constrained by being sandwiched between the blank hold rollers 810*a* and 810*b*.

The portion of the plate material 1 which corresponds to the distance L8 is subjected to, for example, gradual stretching processing as described with respect to FIG. 6, and is thereby stretched.

In this example, among the pair of upper and lower blank hold rollers 810*a* and 810*b*, a bead (convex bead) 811 which protrudes in a round shape is formed on the outer peripheral surface of the upper blank hold roller 810*a*. By contrast, on the outer peripheral surface of the lower blank hold roller 810*b*, a concave recessed portion (concave bead) 812 corresponding to the bead 811 is formed.

The part of the plate material 1 which is sandwiched between the pair of upper and lower blank hold rollers 810*a* and 810*b* is securely constrained while being formed into a deformation portion 1B along the outside shape of the bead 811.

The deformation portion 1B may be previously formed in a separate step such that in the expansion step, the plate material 1 is constrained along the outside shape of the deformation portion 1B with the blank hold rollers 810*a* and 810*b*. In this case, the blank hold rollers 810*a* and 810*b* may not necessarily be formed in the shape of a rotatable roller. For example, if the blank hold rollers vertically have a convex bead and a concave bead which sandwich the blank material, the plate material 1 can be constrained by hooking the convex bead and the concave bead on the deformation portion 1B.

Although in the present example, among blank hold rollers arranged on both sides of a pressure roller (unillustrated), the beads are provided only on the blank hold rollers 810*a* and 810*b* on one side, the beads can naturally be provided on blank hold rollers on both sides (when they are illustrated, the blank hold rollers 810*a* and 810*b* and blank hold rollers 810*c* and 810*d*) such that the plate material 1 can be constrained.

Hence, in the stretching step of the expansion step, a sufficient constraining force can be obtained while the width of the region used for constraining the plate material 1 is relatively narrowed. Thus, as a result, the material yield can be further enhanced.

Figure 9:
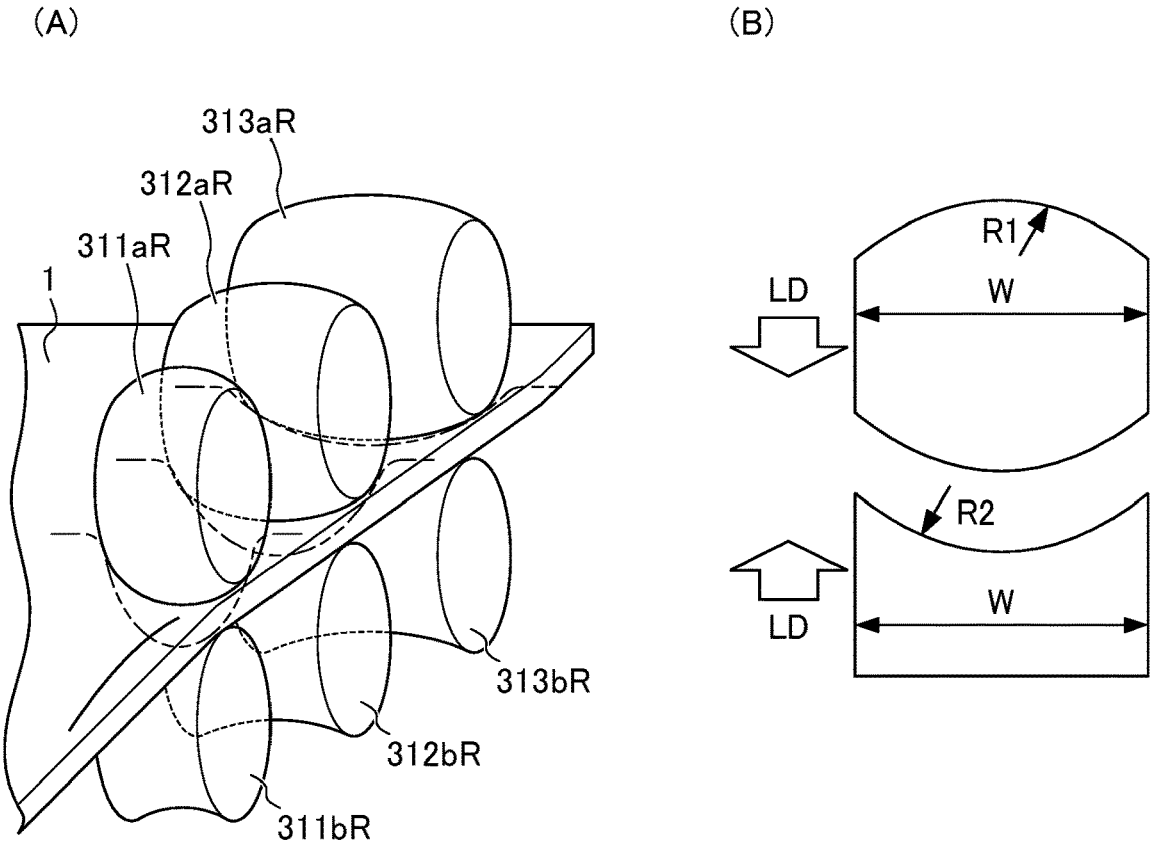
FIG. 9 is a diagram for illustrating an example of a smoothing step in the expansion step in the process diagrams of FIGS. 2 and 7.

FIG. 9 is a diagram for illustrating an example of a smoothing step in the expansion step of the process diagrams of FIGS. 2 and 7.

The plate material 1 which is deformed and stretched into a nonplanar shape (concave shape) in the stretching step (FIGS. 2 and 7: P210), which is the preceding step, is subjected to the smoothing step P220.

The (A) portion of FIG. 9 shows a mechanical portion for performing the smoothing step P220. Here, among the smoothing processing tools of the plate material expansion device 40 described with reference to FIG. 4, individual smoothing rollers which are smoothing processing tools for smoothing the right end side of the plate material 1 are used as representatives of the mechanism corresponding to the smoothing processing tool.

The (B) portion of FIG. 9 typically shows the cross sections of the upper and lower smoothing rollers.

The configurations and actions of the mechanical portion for the smoothing step will now be described in detail reference to both FIGS. 9 and 4.

With reference to FIG. 4, as described previously, the smoothing processing tool is configured such that the mechanical portion for smoothing the left end side of the plate material 1 includes the upper smoothing rollers 311*a*L,

312$a$L and 313$a$L and the lower smoothing rollers 311$b$L, 312$b$L and 313$b$L which are hidden behind the plate material 1 so as not to be seen in FIG. 4.

The mechanical portion for smoothing the right end side of the plate material 1 includes upper smoothing rollers 311$c$L, 312$c$L and 313$c$L and lower smoothing rollers 311$d$L, 312$d$L and 313$d$L.

The mechanical portion for smoothing the left end side of the plate material 1 and the mechanical portion for smoothing the right end side of the plate material 1 have a similar configuration and action. Hence, for the mechanical portion and action for performing the smoothing step P220, the individual smoothing rollers which are the processing tools for smoothing the right end side of the plate material 1 will first typically be described.

In each of upper smoothing rollers 311$a$R, 312$a$R and 313$a$R in the mechanical portion for smoothing the right end side of the plate material 1, as typically shown in the portion (B) (upper side) of FIG. 9, the cross section taken along the shaft forms a curve having an outward convex shape so that the diameter of the rollers' center portion in the shaft direction is the largest, and the diameter of their left and right end surfaces is the smallest. In other words, as a whole, it is formed substantially in a shape of a spindle. With respect to the curvature R1 of the convex shape of the individual smoothing rollers, the curvature of the head smoothing roller 311$a$R is the steepest, the curvature of the last smoothing roller 313$a$R is the gentlest, and the curvature of the smoothing roller 312$a$R therebetween is about intermediate between both of them.

With respect to each of the lower smoothing rollers 311$b$R, 312$b$R and 313$b$R, as typically shown in the portion (B) (lower side) of FIG. 9, the cross section taken along the shaft forms a curve having an outward concave shape so as to correspond to each of the upper smoothing rollers 311$a$R, 312$a$R and 313$a$R described above. In other words, it is formed as a whole substantially in the shape of a bobbin. With respect to the curvature R2 of the concave shape likewise, the curvature of the head smoothing roller 311$b$R is the steepest, the curvature of the last smoothing roller 313$b$R is the gentlest, and the curvature of the smoothing roller 312$b$R therebetween is about intermediate between both of them.

With respect to each of the upper smoothing rollers 311$a$R, 312$a$R and 313$a$R and each of the lower smoothing rollers 311$b$R, 312$b$R and 313$b$R, the width W thereof becomes gradually wider, starting from the head smoothing rollers 311$a$R and 311$b$R toward each of the rear smoothing rollers.

With the pair of upper and lower smoothing rollers 311$a$R and 311$b$R as described above, a load LD which is appropriately adjusted by a hydraulic mechanism or the like is applied from above and below to the deformed plate material 1, and thus as the first smoothing processing P221, the deformation portion of the plate material 1 is flattened. In the first smoothing processing P221 described above, the portion of the plate material 1 which is deformed deeply into a nonplanar shape (concave shape) is sandwiched from above and below in a narrow width range relative to the second and third smoothing processing (FIG. 2: P222 and P223) and is thereby flattened.

The configurations and actions of the pair of upper and lower smoothing rollers 311$a$L and 311$b$L forming the mechanical portion for smoothing the left end side of the plate material 1 are the same as those of the pair of upper and lower smoothing rollers 311$a$R and 311$b$R on the right end side. In other words, the first smoothing processing P221 described above is actually performed with the mechanical portion including these pairs of left and right and upper and lower smoothing rollers.

The configurations and actions of the pair of upper and lower smoothing rollers 312$a$R and 312$b$R and the pair of upper and lower smoothing rollers 312$a$L and 312$b$L are also similar to those of the above-described mechanism for performing the first smoothing processing P221. The difference is that the curvatures R1 and R2 of the convex shape and the concave shape of the peripheral surface of the pair of upper and lower smoothing rollers are medium, and the portion of the plate material 1 which is deformed into a nonplanar shape (concave shape) is sandwiched from above and below in a wider width range than in the first smoothing processing P221 and is flattened by applying the load LD which is appropriately adjusted.

In other words, with the mechanism including the pair of upper and lower smoothing rollers 312$a$R and 312$b$R on the right end side and the pair of upper and lower smoothing rollers 312$a$L and 312$b$L on the left end side, the second smoothing processing P222 in the smoothing step P220 of FIG. 2 is performed.

Furthermore, the configurations and actions of the pair of upper and lower smoothing rollers 313$a$R and 313$b$R and the pair of upper and lower smoothing rollers 313$a$L and 313$b$L are similar to those of the above-described mechanism for performing the first smoothing processing P221 and the second smoothing processing P222. The difference is that the curvatures R1 and R2 of the convex shape and the concave shape of the peripheral surface of the pair of upper and lower smoothing rollers are relatively the gentlest, and the portion of the plate material 1 which is deformed into a nonplanar shape (concave shape) is sandwiched from above and below in a wider width range than in the first smoothing processing P221 and the second smoothing processing P222 and is flattened by applying the load LD which is appropriately adjusted.

In other words, with the mechanism including the pair of upper and lower smoothing rollers 313$a$R and 313$b$R on the right end side and the pair of upper and lower smoothing rollers 313$a$L and 313$b$L on the left end side, the third smoothing processing P223 in the smoothing step P220 of FIG. 2 is performed.

The plate material 1 which is deformed into a concave shape and is stretched is, as described above, subjected to the first smoothing processing P221, the second smoothing processing P222, and the third smoothing processing P223, and is flattened sequentially and gradually. Hence, the end portion of said plate material 1 is satisfactorily and appropriately flattened in the smoothing step.

Figure 10:
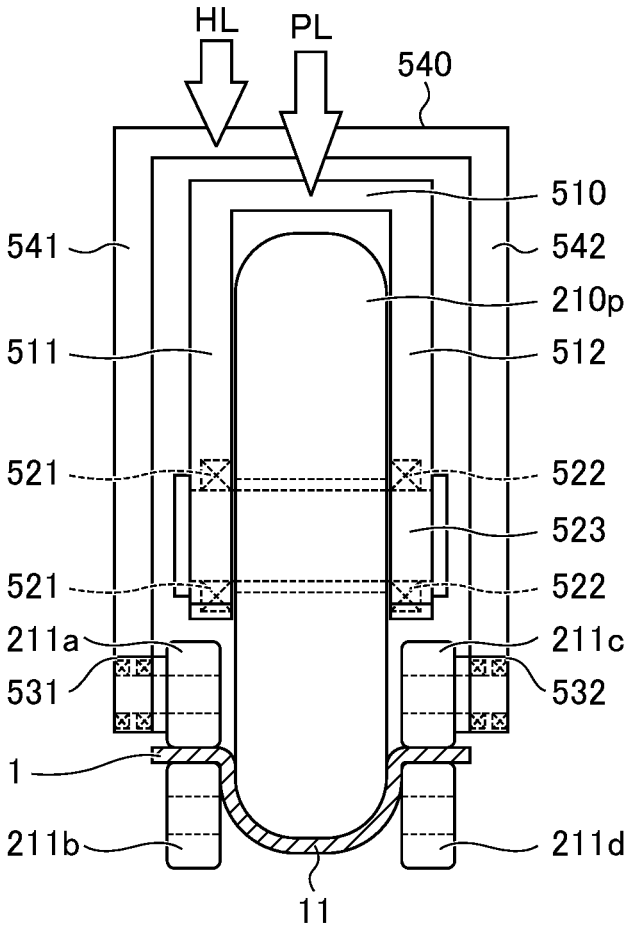
FIG. 10 is a front view of a main portion of a mechanism which is applied to the stretching step in the expansion step in the process diagrams of FIGS. 2 and 7.

FIG. 10 is a front view of a main portion of the mechanism which is applied to the stretching step in the expansion step in the process diagrams of FIGS. 2 and 7.

Figure 11:
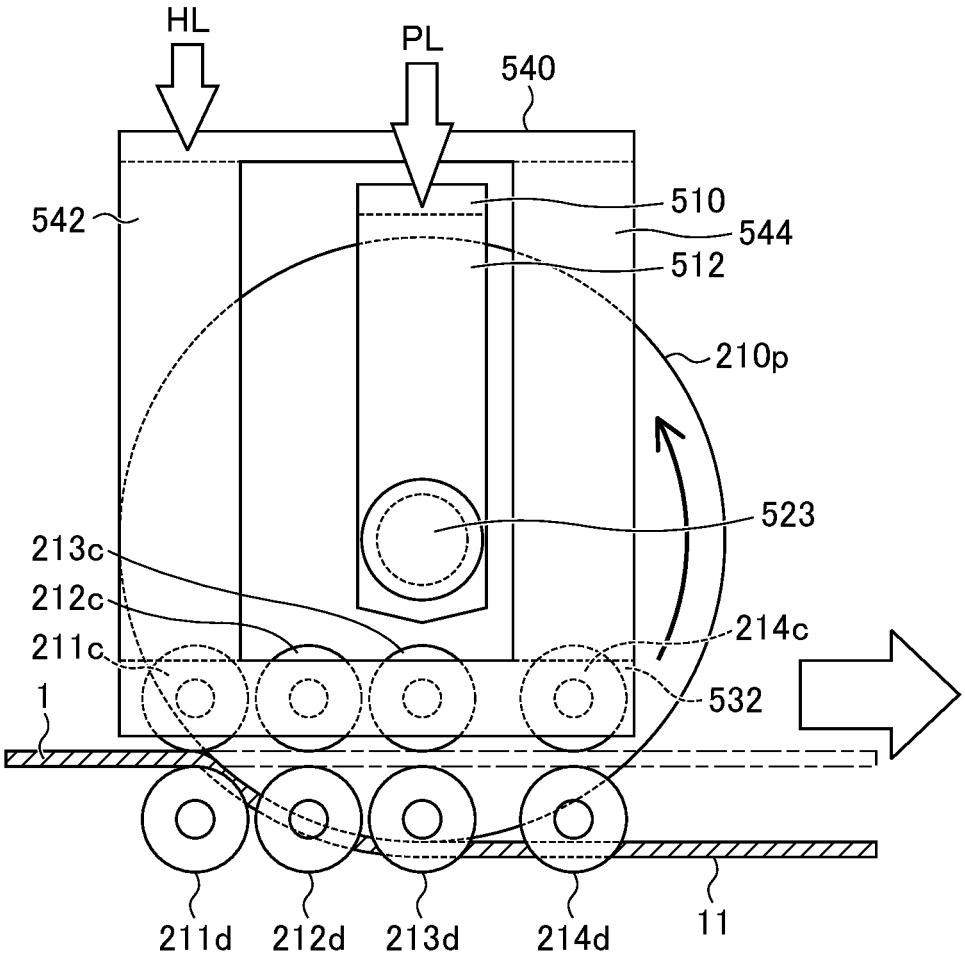
FIG. 11 is a side view of the main portion corresponding to the front view of the main portion of FIG. 10.

FIG. 11 is a side view of the main portion corresponding to the front view of the main portion of FIG. 10.

An example of the mechanism which is applied to the stretching step P210 described above will now be described with reference to FIGS. 10 and 11.

In the previously described processings from the first stretching processing P211 to the fifth stretching processing P215 in the stretching step P210, mechanisms (processing tools) which have slightly different shapes and scales but substantially the same types of configurations and actions are applied. Hence, in the description with reference to FIGS. 10 and 11, the typical mechanism which is applied to the first stretching processing P211 will be described in detail. The mechanism which is applied to the first stretching processing P211 has a pair of left and right configurations, and the configurations are similar. Hence, here, the configurations will be typically described without distinction of left and right, and "L" and "R" as applied to the end of symbols, as in FIG. 4, are omitted.

On both left and right sides of the pressure roller 210*p*, support members 511 and 512, which form a pair of leg portions hung in a vertical direction from a coupling member 510 connected directly or indirectly to an unillustrated structure member, are provided. With respect to the pressure roller 210*p*, its shaft 523 is supported by support members 511 and 512, and also by bearings 521 and 522 in the vicinity of the lower ends of the support members. The left and right support members 511 and 512 are coupled with the coupling member 510 above the pressure roller 210*p* so as to straddle the top portion of the outer periphery of the pressure roller 210*p*.

Along the transport direction of the plate material 1 indicated by an arrow, the blank hold roller 211*a* on the upper left side and the blank hold rollers 212*a*, 213*a* and 214*a* which are not seen in the figure are arranged so as to be aligned in the order described above and are cantilever-supported with the shaft by a horizontal support member 531.

Likewise, the blank hold rollers 211*c*, 212*c*, 213*c* and 214*c* on the upper right side are arranged so as to be aligned in the order described above and are cantilever-supported with the shaft by a horizontal support member 532.

The blank hold roller 211*b* on the lower left side and the blank hold rollers 212*b*, 213*b* and 214*b* which are not seen in the figure are arranged so as to be aligned in the order described above, corresponding to the blank hold roller 211*a* on the upper left side and the blank hold rollers 212*a*, 213*a* and 214*a* which are not seen in the figure, and are supported with the shaft such that they can sandwich the plate material 1.

Likewise, the blank hold rollers 211*d*, 212*d*, 213*d* and 214*d* on the lower right side are arranged so as to be aligned in the order described above, corresponding to the blank hold rollers 211*c*, 212*c*, 213*c* and 214*c* on the upper right side, and are supported with the shaft such that they can sandwich the plate material 1.

The horizontal support members 531 and 532 are supported with support members 541, 542, 543 (not seen in the figure) and 544 which form two pairs of leg portions hung in the vertical direction from a coupling member 540 connected directly or indirectly to an unillustrated structure member.

The coupling member 540 includes a portion which is located above the previously described coupling member 510 and couples the support members 541 and 542 forming a pair of left and right leg portions so as to straddle the outer periphery of the pressure roller 210*p* above its first half portion, and a portion which likewise couples the support members 543 and 544 forming a pair of left and right leg portions so as to straddle the outer periphery of the pressure roller 210*p* above its second half portion, and the two portions are aligned forward and backward at the same level and are integrally formed.

The distance between the support members 541 and 542 forming a pair of left and right leg portions and the distance between the support members 543 and 544 forming a pair of left and right leg portions are wider than the distance between the left-and-right outer sides of the support members 511 and 512 of the pressure roller 210*p* forming the pair of leg portions described above.

In the positions on both left and right sides of the pressure roller 210*p*, the movement of the plate material 1 in a direction (the shaft direction of each blank hold roller) intersecting the transport direction (direction indicated by the arrow) is securely constrained with the upper and lower blank hold rollers 211*a*, 212*a*, 213*a*, 214*a*, 212*b*, 213*b* and 214*b* on the left side and the upper and lower blank hold rollers 211*c*, 212*c*, 213*c*, 214*c*, 211*d*, 212*d*, 213*d* and 214*d* on the right side.

In other words, in the plate material expansion device according to the embodiment of the present invention, the upper and lower blank hold rollers 211*a*, 212*a*, 213*a*, 214*a*, 212*b*, 213*b* and 214*b* on the left side and the upper and lower blank hold rollers 211*c*, 212*c*, 213*c*, 214*c*, 211*d*, 212*d*, 213*d* and 214*d* on the right side form the holding processing tool for holding both side parts of the part of said plate material which is pressurized and stretched with the pressing member (the pressure roller 210*p*) of the stretching processing tool (the pressure roller 210*p*, the shaft 523 and the like).

In order to appropriately perform such constraints, a load HL is applied by a hydraulic device or the like from above the coupling member 540, and the load HL acts on the individual blank hold rollers through the support members 541, 542, 543 and 544 and the horizontal support members 531 and 532.

A load PL which is applied by a hydraulic device or the like from above the coupling member 510 acts on the pressure roller 210*p* through the support members 511 and 512, and the plate material 1 is bent and stretched so as to form a region that serves as the portion 11 which is stretched outward when flattened later in the smoothing step P210.

In other words, the pressure roller 210*p*, the support members 511 and 512, the shaft 523 and the like form, in the plate material expansion device according to the embodiment of the present invention, the stretching processing tool which brings its pressing member (the pressure roller 210*p*) into contact with the end portion of said plate material 1 to pressurize and stretch the end portion of the plate material.

As described above, the pressure roller 210*p* and the individual blank hold rollers are all driven rollers, and are rotated as the plate material 1 is moved with a separate transport device (unillustrated) in the transport direction (direction indicated by the arrow) and roll in contact with the plate material 1.

As the plate material 1 is moved, the plate material 1 is continuously bent and stretched by the pressure roller 210*p*. The part which is bent and stretched is flattened later as described previously and serves as the end portion (the so-called grip margin) for constraining the blank material when press formed in the forming step P2 of FIGS. 2 and 7.

As described above, in the description with reference to FIGS. 10 and 11, the mechanism on one side of the pair of mechanisms applied to the first stretching processing P211 in the mechanism applied to the stretching step P210 is typically described in detail. The mechanism applied to the first stretching processing P211 is formed with the pair of left and right mechanisms shown in FIGS. 10 and 11.

Furthermore, in the mechanism applied to the second stretching processing P212, the distance between the left and right blank hold rollers in the mechanism shown in FIGS. 10 and 11 is relatively wide, and the thickness dimension of the pressure roller is relatively thick. As with the mechanism applied to the first stretching processing P211, a pair of left and right mechanisms in which the width is further widened as described above is formed.

In the mechanism applied to the gradual processing from the first stretching processing P211 to the fifth stretching processing P215, the distance between the left and right blank hold rollers is increased stage by stage, and the thickness (width) dimension of the corresponding pressure roller is also increased stage by stage. The relationship of the dimensions of the mechanical portion applied to the stretching processing in each stage is understood with reference to FIG. 5 as described above.

Through the previously described five-stage processings P211 to P215 of the stretching step P210, the plate material 1 is stretched satisfactorily and reliably.

As described above, in the present embodiment, when the peripheral edge portion of the plate material 1 which is the raw material is stretched with the pressure roller 210*p* and thus the blank material is obtained, both sides of the target part to be stretched are reliably constrained with the blank hold rollers. Hence, with respect to the product shape part of the obtained blank material, the thickness dimension is maintained according to the quality standards without being affected by the stretching processing on the peripheral edge portion.

In the forming step P2 of FIGS. 2 and 7, as described above, the grip margin of the blank material formed in the peripheral edge portion of the plate material 1 is constrained so as to be sandwiched between the die of a press molding machine and the blank holder or between the upper and lower blank holders, the product shape part of the blank material is pressed into the side of the die with a punch, and thus normal press forming is performed.

Consequently, while applying a plate material smaller than the normal blank material as the plate material for press forming, a blank material, wherein a constrained part corresponding to the grip margin is formed while its product shape part has dimensions equal to the normal blank material, is acquired through the expansion step P1. Hence, the material yield can be enhanced while minimizing the dimensional error in the product shape part at the time of press forming.

Although cases where the blank hold rollers and the pressure roller are all driven rollers were described in detail in the embodiments described above, the present invention is not limited to this example, and at least any one of these rollers may be a main driving roller which is rotated by the power of a motor or the like.

EXPLANATION OF REFERENCE NUMERALS

1: plate material
10: blank material
11: grip margin
211*a*L, 212*a*L, 213*a*L: blank hold rollers (left of the plate material, upper left side)
211*b*L, 212*b*L, 213*b*L: blank hold rollers (left of the plate material, lower left side)
211*c*L, 212*c*L, 213*c*L: blank hold rollers (left of the plate material, upper right side)
211*d*L, 212*d*L, 213*d*L: blank hold rollers (left of the plate material, lower right side)
211*a*R, 212*a*R, 213*a*R: blank hold rollers (right of the plate material, upper left side)
211*b*R, 212*b*R, 213*b*R: blank hold rollers (right of the plate material, lower left side)
211*c*R, 212*c*R, 213*c*R: blank hold rollers (right of the plate material, upper right side)
211*d*R, 212*d*R, 213*d*R: blank hold rollers (right of the plate material, lower right side)
210*p*: pressure roller
311*a*L, 312*a*L, 313*a*L: smoothing rollers (upper left side of the plate material)
311*b*L, 312*b*L, 313*b*L: smoothing rollers (lower left side of the plate material)
311*a*R, 312*a*R, 313*a*R: smoothing rollers (upper right side of the plate material)
311*b*R, 312*b*R, 313*b*R: smoothing rollers (lower right side of the plate material)
1E: curved portion

The invention claimed is:

1. A press forming method comprising:
an expansion step of a preceding process; and
a forming step of a following process;
wherein:
the expansion step is a step in which at least partial expanding of an end portion of a plate material is performed so as to obtain a blank material having the end portion and a dimension suitable for the forming step, and to feed the blank material into the forming step;
the forming step is a step in which the blank material fed from the expansion step is formed by constraining a predetermined part of the end portion thereof;
the expansion step includes: a stretching step of pressurizing and stretching the end portion of the plate material with a stretching processing tool; and a smoothing step of flattening the end portion of the plate material which is deformed into a nonplanar shape in the stretching step; and
the stretching step is a step that is performed in a state where the end portion of the plate material is constrained by a bead part of a member having the bead part formed thereon.

2. The press forming method according to claim 1, wherein a bending step of bending a tip end portion of the plate material before the stretching step is performed, and
the stretching step is performed while a curved portion of the tip end portion of the plate material bent in the bending step is hooked on a holding processing tool.

3. The press forming method according to claim 1, wherein
the smoothing step is a step that is gradually performed by performing a plurality of smoothing processings with differently shaped smoothing processing tools.

4. A press forming method comprising:
an expansion step of a preceding process; and
a forming step of a following process;
wherein:
the expansion step is a step in which at least partial expanding of an end portion of a plate material is performed so as to obtain a blank material having the end portion and a dimension suitable for the forming step, and to feed the blank material into the forming step;
the forming step is a step in which the blank material fed from the expansion step is formed by constraining a predetermined part of the end portion thereof;
the expansion step includes: a stretching step of pressurizing and stretching the end portion of the plate material with a stretching processing tool; and a smoothing step of flattening the end portion of the plate material which is deformed into a nonplanar shape in the stretching step;
a bending step of bending a tip end portion of the plate material before the stretching step is performed, and the stretching step is performed while a curved portion of the tip end portion of the plate material bent in the bending step is hooked on a holding processing tool.

5. The press forming method according to claim 4, wherein the smoothing step is a step that is gradually performed by performing a plurality of smoothing processings with differently shaped smoothing processing tools.

6. A press forming method comprising:

an expansion step of a preceding process; and a forming step of a following process;

wherein:

the expansion step is a step in which at least partial expanding of an end portion of a plate material is performed so as to obtain a blank material having the end portion and a dimension suitable for the forming step, and to feed the blank material into the forming step; and the forming step is a step in which the blank material fed from the expansion step is formed by constraining a predetermined part of the end portion thereof;

the expansion step includes: a stretching step of pressurizing and stretching the end portion of the plate material with a stretching processing tool; and a smoothing step of flattening the end portion of the plate material which is deformed into a nonplanar shape in the stretching step;

the stretching step is a step that is gradually performed by performing a plurality of stretching processings in which a width of the end portion of the plate material to be stretched each time is different; and the stretching step is a step that is performed in a state where the end portion of the plate material is constrained by a bead part of a member having the bead part formed thereon.

7. The A press forming method comprising:

an expansion step of a preceding process; and a forming step of a following process;

wherein:

the expansion step is a step in which at least partial expanding of an end portion of a plate material is performed so as to obtain a blank material having the end portion and a dimension suitable for the forming step, and to feed the blank material into the forming step; and the forming step is a step in which the blank material fed from the expansion step is formed by constraining a predetermined part of the end portion thereof;

the expansion step includes: a stretching step of pressurizing and stretching the end portion of the plate material with a stretching processing tool; and a smoothing step of flattening the end portion of the plate material which is deformed into a nonplanar shape in the stretching step;

the stretching step is a step that is gradually performed by performing a plurality of stretching processings in which a width of the end portion of the plate material to be stretched each time is different;

a bending step of bending a tip end portion of the plate material before the stretching step is performed, and the stretching step is performed while a curved portion of the tip end portion of the plate material bent in the bending step is hooked on a holding processing tool.

* * * * *